United States Patent [19]

Jorgensen

[11] Patent Number: 4,626,260

[45] Date of Patent: Dec. 2, 1986

[54] METHOD OF CONTROLLING THE PULSE FREQUENCY OF A PULSE OPERATED ELECTROSTATIC PRECIPITATOR

[75] Inventor: Hans J. Jorgensen, Lyngby, Denmark

[73] Assignee: F. L. Smidth & Co. A/S, Copenhagen, Denmark

[21] Appl. No.: 808,041

[22] Filed: Dec. 12, 1985

[30] Foreign Application Priority Data

Dec. 12, 1984 [GB] United Kingdom ..... 8431293

[51] Int. Cl.[4] ..... B03C 3/68

[52] U.S. Cl. ..... 55/2; 55/105; 323/903

[58] Field of Search ..... 55/2, 105, 4, 139; 323/903

[56] References Cited

U.S. PATENT DOCUMENTS

| | | | |
|---|---|---|---|
| 3,641,740 | 2/1972 | Schumann et al. | 55/105 |
| 4,138,233 | 2/1979 | Masuda | 55/139 |
| 4,209,306 | 6/1980 | Feldman et al. | 55/2 |
| 4,354,860 | 10/1982 | Herklotz et al. | 55/105 |
| 4,413,225 | 11/1983 | Donig et al. | 55/105 X |
| 4,445,911 | 5/1984 | Lind | 55/2 |

*Primary Examiner*—Kathleen J. Prunner

*Attorney, Agent, or Firm*—Brumbaugh, Graves, Donohue & Raymond

[57] ABSTRACT

A method of controlling the pulse frequency of an electrostatic precipitator energized by a pulse superimposed direct voltage, is disclosed in which, for a given direct and/or pulse voltage, the pulse repetition frequency, at intervals which are preset or determined by one or more precipitator or operational parameters, is lowered and then increased stepwise according to a predetermined scale. At each value of the pulse repetition frequency the average current being measured and the transmitted charge per pulse (defined as the average current divided by the pulse repetition frequency) calculated. The stepwise increase of the pulse frequency is stopped when either the transmitted charge per pulse for a given direct and pulse voltage maintained in two successive frequency steps remains constant or increases or, where the charge per pulse is kept constant by regulating the direct and/or pulse voltage, when the numerical value of the controlled voltage in the last one or two successive frequency steps remains constant or drops. The limiting pulse repetition frequency is controlled to assume the frequency in the step where the stepwise frequency increase is stopped, until the next search procedure.

13 Claims, 4 Drawing Figures

METHOD OF CONTROLLING THE PULSE FREQUENCY OF A PULSE OPERATED ELECTROSTATIC PRECIPITATOR

The invention relates to a method of controlling the pulse frequency of an electrostatic precipitator energized by a pulse superimposed direct voltage to achieve maximum cleaning of the incoming gas, such a precipitator is hereinafter referred to as "of the kind described".

It is known that in pulse operated electrostatic precipitators, i.e. electrostatic precipitators energized by a pulse superimposed direct voltage, a better separation of high-resistive dust is achieved than in conventional direct voltage energized electrostatic precipitators of corresponding size. The improvement is inter alia due to improved current control as the high voltage pulse is usuable to ensure a powerful corona discharge across the whole precipitator section, whilst a suitable choice of the pulse repetition frequency can ensure that the average current is kept sufficiently low to avoid so-called back corona, i.e. electrical discharges in the separated dust.

European Patent specificatins Nos. EP-A-0055525 and EP-A-0054378 describe methods for automatic control of the underlying DC-level and the pulse voltage to ensure the best possible adaptation thereof to the existing operational situation of the precipitator and of the pulse repetition frequency, so as to maintain, as far as possible, a preselected average current, irrespective of the voltage level.

However, the average current for ensuring optimum precipitation changes in dependance on the operational conditions in the precipitator, in particular on the dust resistivity. Experience gained from a large number of precipitator installations shows that optimum precipitation is achieved by the highest average current which only just does not cause discharges in the precipitated dust. Consequently, it is an object of the invention, during operation, to determine the maximum permissible average current, and based thereon to control the pulse repetition frequency.

According to the invention a search procedure is carried out in a pulse operated precipitator of the kind described at a selected intervals, during which procedure the pulse repetition frequency is lowered and then increased stepwise according to a predetermined scale;

the DC-voltage ($V_{DC}$), the pulse voltage ($V_p$) and the average current through the precipitator are measured for each value of the pulse repetition frequency;

the charge ($q_p$) transmitted per pulse is calculated as the average current divided by the pulse repetition frequency;

one of the two parameters $|V_{DC}|+|V_p|$ and $q_p$ is maintained constant while the other is varied, the stepwise increase of the pulse frequency being stopped when the value of the expression:

$$(|V_{DC}|+|V_p|)/q_p$$

remains constant or drops in the second of two successive frequency steps; and, the limit of the pulse repetition frequency being determined by the frequency in the step where the stepwise frequency increase is stopped.

In practice this may be done by maintaining the DC-voltage and the pulse voltage constant and stopping the stepwise increase of the pulse repetition frequency when the transmitted charge per pulse remains constant or increases when passing from one frequency step to the succeeding one.

Alternatively, the charge per pulse may be kept constant by regulating the sum of the numerical values of the DC-voltage and the pulse voltage and stopping the stepwise increase of the pulse frequency when the regulated voltage remains constant or drops when passing from one frequency step to the successive one. This may be achieved by keeping one of $V_{DC}$ or $V_p$ constant and varying the other, or by varying both.

Preferably, the determination of the scale for changing the pulse repetition frequency is automatically performed in advance of each search procedure on the basis of one or more continuously monitored/measured precipitator or operational parameters, for example, depending on the temperature within the precipitator.

Similarly, the presetting of the intervals between the search procedures can be currently automatically performed on the basis of such continuously monitored/-measured parameters.

As the described method only sets the pulse frequency at shorter or longer time intervals, which may either be preset or continuously controlled by one or more continuously measured precipitator or operational parameters, so that the setting occurs more often or more rarely dependant on the need created by the existing operational condition, advantageously the average current set by the setting of the pulse frequency is maintained at the set value set until the next setting sequence by control of the pulse frequency.

The average current that is set and maintained may have been created by adding a safety factor correction to the average current which is set immediately the pulse frequency is set. The sign and the size of such a correction may, according to the invention, be determined by one or more continuously monitored/-measured precipitator or operational parameters, for example the rate of change of the pulse rate during the search procedure.

If the maximum pulse repetition frequency of the power supply is reached without fulfilling the established criteria for stopping the stepwise upwards regulation of the frequency, the pulse voltage is stepwise upwardly regulated until a certain preselected spark-over frequency is tansgressed, and the existing precipitator current is used as a basis of the calculation of the current value to be aimed at in the period until the next search, a possible positive correction, however, being omitted. The preselected spark-over rate, which may be equipment dependent, may be controlled in accordance with our No. EP-A-0054378.

Similarly, a stepwise upwards regulation of the DC-level is made if both the pulse repetition frequency and the pulse voltage have reached maximum values without the permissible spark-over frequency having been transgressed.

The measurement of precipitator current in the individual steps of the search procedure is made over a period of time sufficiently long to obtain a stable working point. This period of time may either be preset, being chosen on the basis of knowledge of the operational conditions of the precipitator and plant in question, or be variable (being at least 1 sec.) in which case the duration of the measuring period is determined (by an automatic control unit) according to the variations occurring in the measured values, and stable operation is characterized in that the variations within a preselected period of time lie within an interval which may either be fixed or dependant on the existing current value.

The direct voltage and pulse voltage levels can be chosen during the search procedure so that only very restricted corona current occurs by the direct voltage alone, and so that the spark-over probability is low when superimposing the pulses on the direct voltage. If, in spite of this, the spark-over frequency supercedes the permissible level for the power supply, the search procedure is stopped and started all over again with a lower pulse voltage.

An electrostatic precipitator is often composed of several sections, each of which may have its own power supply, the pulse repetition frequency of which is controlled as described above.

If the control units of the individual sections are connected to a superior control unit this unit may be adapted so as to control totally or partly the search procedure and to coordinate the searches of the individual sections to avoid unwanted coinciding and resulting increased dust emission.

The invention is based on the recognition that the voltage drop over the precipitated dust layer on the collecting system of an electrostatic precipitator affects the charge per pulse, and that the voltage drop increases with increasing average current in the precipitator until the occurrence of discharges in the dust layer, so-called back corona, which will restrict the voltage drop to a certain maximum value, when simultaneously ions are liberated having opposite polarity in relation to that of ions generated by the emission system. Until the start of the back corona the charge per pulse will consequently drop when the maximum voltage on the precipitator is maintained, whereas it will be constant or increasing after the occurrence of the back corona becuase of the restricted voltage drop over the dust layer, and because of the improved conductivity of the gas between the electrode systems.

Examples of methods according to the invention will now be described with reference to the accompanying drawings in which.

Figure 1:
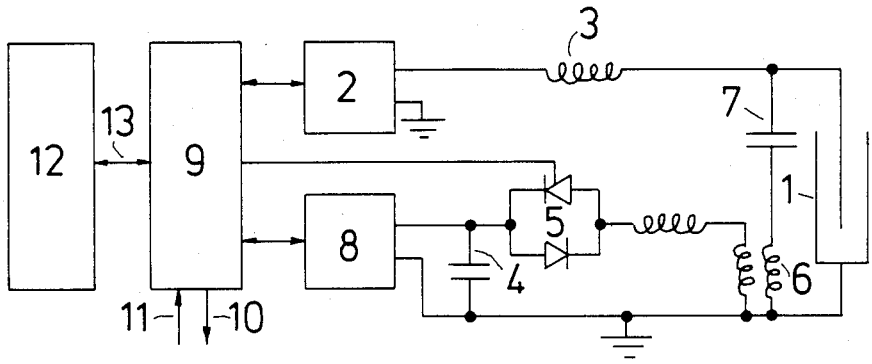
FIG. 1 shows, diagramatically, a precipitator section with appertaining power supply and control equipment.

In FIG. 1 a precipitator section 1 is energized by direct voltage from a high-voltage rectifier 2 via an inductance 3 while the pulse voltage is generated in an oscillatory circuit consisting of a storage condenser 4, a switch element 5 consisting of a thyristor column and an anti-parallel diode column, a pulse transformer 6, a coupling capacitor 7 and the precipitator section 1. The amplitude of the pulse voltage is determined by the voltage from a charger 8, which together with the switch element 5 and the high-voltage rectifier 2 is controlled by a control unit 9, called a section control unit, corresponding to the section of the precipitator in question. The section control unit may, as indicated in FIG. 1, be adapted to receive and output other signals involved in the control of the individual section or the entire precipitator on the lines 10 and 11. It may also be connected to a superior control unit 12 via a connection 13 which may pass information both ways. These control units may be digital, analogue or combinations thereof. The section control 9 may handle all control functions of the individual power supply, or one or more or these functions may be handled by the superior control unit 12.

The control unit 9 keeps the DC voltage (via rectifier 2) at a level not exceeding the corona-on voltage, and keeps the pulse voltage $V_p$ (via charger 8) from exceeding a maximum level not causing too frequency spark-overs.

The limiting or maximum pulse frequency is controlled (through switch element 5) to a frequency at which back corona is just avoided. This is obtained by carrying out a search procedure by which the pulse frequency is first lowered and then increased stepwise until the back corona starts. How often such search procedures are carried out is decided according to the programming of the control unit 9 on the basis of information received by this concerning the precipitator or other operational parameters on the input line 11.

Further, the programming of the unit 9 decides the magnitude of the steps of the stepwise frequency increase. This decision may be made on the basis of information received on the input line 11, e.g. precipitator temperature, but also on the basis of a memory of the frequency immediately before the beginning of the search procedure as the first steps may be maintained at a large value until a frequency near the frequency immediately before the search procedure is reached, whereafter the steps become smaller. Another possibility is to let the steps be continuously increasing, e.g. following a mathematical progression.

Figure 2:
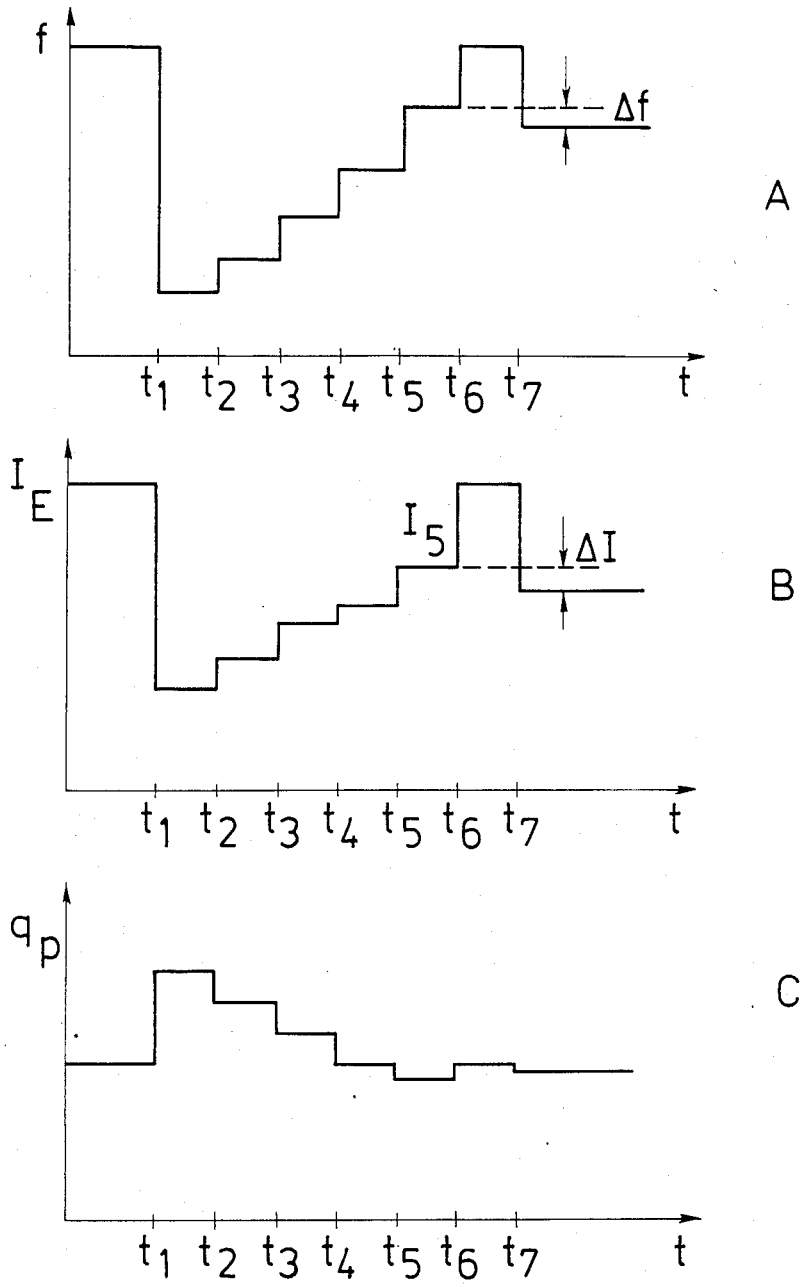
FIG. 2 shows an example of frequency, current and charge sequences when using a first example of the method of the invention.

In FIG. 2, where the curves A, B and C show the pulse frequency f, the precipitator current $I_E$ and the charge per pulse $q_p$, respectively, as a function of time t, the sequence performed by one single power supply during one of the above searches towards maximum permissible precipitator current is illustrated. Before the search is initiated at the time $t=t_1$, the direct voltage and the pulse voltages have been reduced to levels where no corna occurs from the direct voltage, and where the spark-over probability is low. At the time $t_1$ the repetition frequency f is lowered from the existing level, which will be dependent on the operational conditions of the plant, e.g. the temperature in the precipitator, to a lower level also determined in the same way. The average current $I_E$ is measured and converted into charge per pulse, $q_p$. At the time $t_2$ the repetition frequency is increased by one step on the scale chosen, in this case an arithmetic progression, and $q_p$ is determined again by measuring the average current. As $q_p$ is decreasing, the stepwise upwards regulation continues until $t=t_6$, where $q_p$ increases. The existing current value $I_5$ is hereafter corrected, by application of a correction frequency $\Delta f$ to the pulse repetition frequency, by the safety correction $\Delta I$ to obtain the precipitator current desired, until the search procedure is next carried out, the limiting or maximum repetition frequency being as determined at time $t_7$ (i.e. as corrected by the factor $\Delta f$). Upon completion of the search procedure the direct and pulse voltages are controlled to reach the level they had before the search was started.

Figure 4:
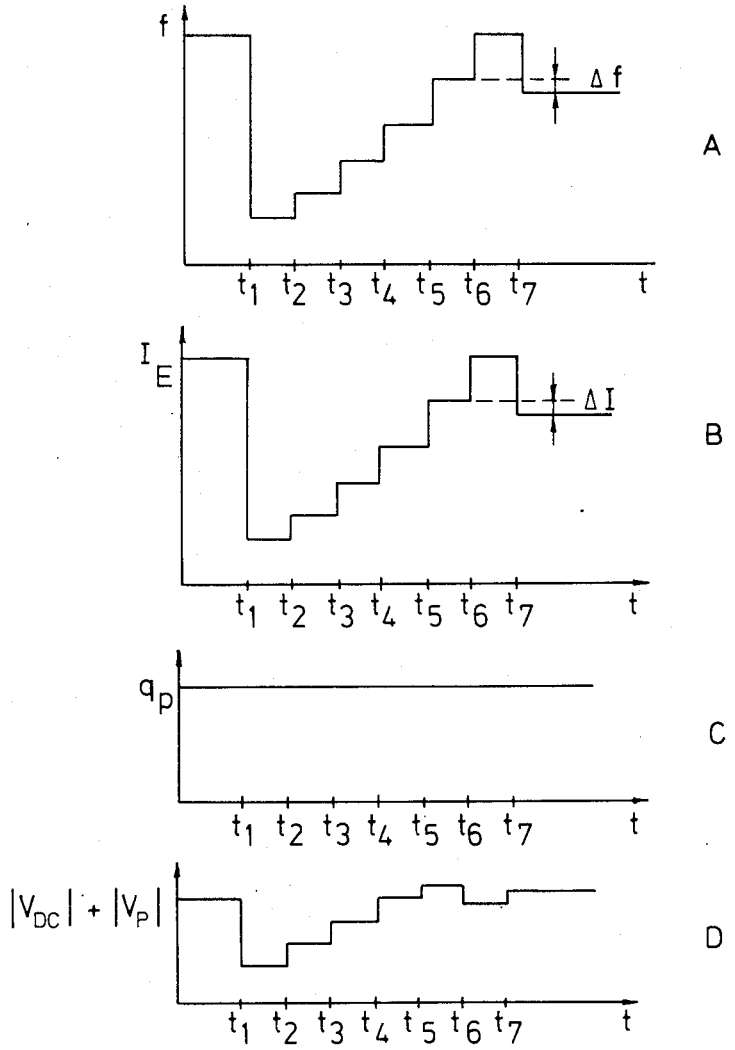

In FIG. 4 the curve A shows the pulse frequency f as a function of time t, which frequency is first lowered and then increased stepwise.

To obtain an unchanged charge transmission per pulse $q_p$ as illustrated by the straight line C, the average current $I_E$ must be reduced and increased proportionally with the pulse frequency, as illustrated by the curve B. This may be achieved either through keeping the DC voltage $V_{DC}$, at its value before the beginning of the search procedure and regulating the pulse voltage, $V_p$, to obtain the desired average current, or through keeping the pulse voltage $V_p$ at its value before the beginning of the search procedure and regulating the DC voltage $V_{DC}$ or by varying both. In either case $|V_{DC}|+V_p|$ is varied.

The curve D illustrates how $|V_{DC}|+|V_p|$ should be varied. The search procedure is stopped when $|V_p|$ remains constant or drops when passing from the step beginning at $t_5$ to the successive one beginning at $t_6$ the first of these two stops representing, with the correction $\Delta f$, the limiting pulse frequency which is maintained until the next search procedure.

Figure 3:
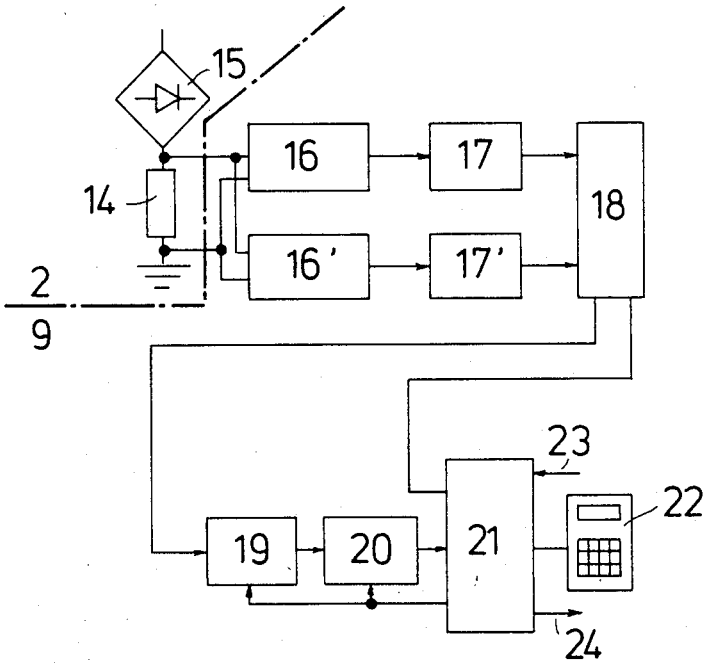
FIG. 3 shows a practical embodiment of such part of the control equipment which affects the control of the pulse repetition frequency; and, FIG. 4 shows a further example of frequency, current and charge sequences when using an alternative method of the invention.

FIG. 3 shows an embodiment using a microprocessor to control the search procedure. The figure shows elements, some of which form part of the DC voltage regulator 2 and some of which form part of the section control 9. The microprocessor can handle a large number of other tasks for control purposes, but in FIG. 3 is shown only that part which effects the control of the precipitator current. The voltage is measured over a shunt 14 (to provide a determination of the current therethrough) in the ground wire of the high-voltage rectifier 15 located in the DC voltage regulator 2. The signal is passed from here into the section control 9, specifically to a circuit 16 and 16' converting the measured voltage to frequencies proportional to the measured signal. These frequencies are passed via optical couplers 17 and 17' and a range selector 18 on to a counter 19 with a digital display. The optical couplers provide a galvanic separation of point of measurement and microprocessor. For improved selection there are two parallel voltage/frequency converters with different sensitivity, and the shift between these two is made by the range shifter 18. The digital signal may, via a latch 20, be read by a microprocessor 21 in whose memory the search procedure and the methods of treating measuring data are stored in the form of a program. Parameters for an operating program are entered from a keyboard/display 22. Control and measuring signals including signals for controlling the limiting and actual pulse repetition frequency, and the voltage level, are indicated for simplicity as signal lines 23 and 24.

I claim:

1. A method of controlling the pulse frequency of an electrostatic precipitator energized by a pulse superimposed direct voltage, in which (a) a search procedure is carried out at selected intervals and, during which procedure (b) the pulse repetition frequency is lowered and then increased stepwise according to a selected scale;

(c) the DC-voltage ($V_{DC}$), the pulse voltage ($V_p$) and the average current through the precipitator are measured for each value of the pulse repetition frequency;

(d) the charge ($q_p$) transmitted per pulse is calculated as the average current divided by the pulse repetition frequency;

(e) one of the two parameters $|V_{DC}|+|V_p|$ and $q_p$ is maintained constant while the other is varied, said stepwise increase of the pulse frequency being stopped when the value of the expression:

$$(|V_{DC}|+V_p|)/q_p$$

remains constant or drops in the second of two successive frequency steps; and, (f) the limit of said pulse repetition frequency being determined by the frequency in the step where said stepwise frequency increase is stopped.

2. A method according to claim 1, in which said DC-voltage and said pulse voltage are maintained constant and said stepwise increase of said pulse repetition frequency is stopped when the transmitted charge per pulse remains constant or increases when passing from one frequency step to the successive one.

3. A method according to claim 1, in which the charge per pulse is kept constant by regulating said DC-voltage and said stepwise increase of the pulse frequency is stopped when the numerical value of the regulated voltage remains constant or drops when passing from one frequency step to the successive one.

4. A method according to claim 1, in which the charge per pulse is kept constant by regulating said pulse voltage and said stepwise increase of the pulse frequency is stopped when the numerical value of the regulated voltage remains constant or drops when passing from one frequency step to the successive one.

5. A method according to any of the preceding claims, in which said selection of the scale for changing said pulse repetition frequency is automatically performed in advance of each search procedure on the basis of at least one continuously monitored precipitator parameter.

6. A method according to any of claims 1–4, in which said selection of the scale for changing said pulse repetition frequency is automatically performed in advance of each search procedure on the basis of at least one continuously monitored operational parameter.

7. A method according to claim 1, in which the presetting of the intervals between the search procedures is automatically performed on the basis of at least one continuously monitored precipitator parameter.

8. A method according to claim 1, in which the presetting of the intervals between the search procedures is automatically performed on the basis of at least one continuously monitored operational parameter.

9. A method according to claim 1, in which the average current set by the setting of said limiting pulse frequency during said search procedure in the period until the next search period is maintained at said set value by control of said pulse frequency.

10. A method according to claim 9, in which the average current maintained between a search period and the succeeding one is created by adding to the average current set during the latest search period a correction.

11. A method according to claim 10, in which said correction is positive.

12. A method according to claim 10, in which said correction is negative.

13. A method according to claim 10, in which the size and sign of the correction are determined on the basis of at least one continuously measured parameter.

* * * * *

UNITED STATES PATENT AND TRADEMARK OFFICE

CERTIFICATE OF CORRECTION

PATENT NO. : 4,626,260

DATED : Dec. 2, 1986

INVENTOR(S) : Hans J. Jorgensen

It is certified that error appears in the above-identified patent and that said Letters Patent is hereby corrected as shown below:

Column 1, line 25, "specificatins" should be --specifications--; line 45, delete "a". Column 2, line 48, "tansgressed" should be --transgressed--. Column 4, line 14, "frequency" should be --frequent--.

Signed and Sealed this

Twenty-fifth Day of August, 1987

*Attest:*

DONALD J. QUIGG

*Attesting Officer*

*Commissioner of Patents and Trademarks*